US005417630A

United States Patent [19]

Schultz

[11] Patent Number: 5,417,630

[45] Date of Patent: May 23, 1995

[54] IN PLACE EXERCISE DEVICE WITH ADJUSTABLE RESISTANCE

[76] Inventor: Brian W. Schultz, 1678 Prairie Ave., Apt. 22, Dickinson, N. Dak. 58601

[21] Appl. No.: 273,194

[22] Filed: Jul. 11, 1994

[51] Int. Cl.[6] ..... A63B 69/18

[52] U.S. Cl. ..... 482/70; 482/93

[58] Field of Search ..... 482/51, 70, 71, 92, 482/93, 94, 907, 148, 74

[56] References Cited

U.S. PATENT DOCUMENTS

| | | | |
|---|---|---|---|
| 3,941,377 | 3/1976 | Lie | 482/51 |
| 4,811,941 | 3/1989 | Elo | 482/70 |
| 4,915,373 | 4/1990 | Walker | 482/51 |
| 5,108,093 | 4/1992 | Watterson | 482/70 |

*Primary Examiner*—Stephen R. Crow

[57] ABSTRACT

A device for simulating skiing, walking and running with adjustable resistance comprising a base plate positionable in a horizontal orientation having an upper surface and with parallel longitudinal slots formed therein, foot supporting receptacles adapted to receive the feet of a user on the upper surface thereof with mechanisms beneath the lower surfaces thereof extending through the slots to allow for the forward end rearwardly shifting of the receptacle and feet of a user and with liftable mechanisms interconnecting the upper and lower surfaces of the receptacles, a support plate in a vertical orientation having an upper edge and a lower edge, the lower edge coupled to the forward edge of the base plate, a plurality of weights coupled with respect to the vertical support plate with a key to vary the amount of weights to be coupled for being lifted as a function of the desire of the user, flexible coupling interconnecting the lower extent of the foot receptacles with the weights, the coupling being separably attached to each foot receptacle but commonly attached to the weights, the coupling including pulleys whereby upward or rearward movement of either of the foot components will effect the raising of the preselected number of weights while the downward or forward movement of either of the foot components will effect the lowering of the preselected number of weights.

4 Claims, 4 Drawing Sheets

IN PLACE EXERCISE DEVICE WITH ADJUSTABLE RESISTANCE

BACKGROUND OF THE INVENTION

1. Field of the Invention

The present invention relates to in place exercise devices for simulating skiing, walking and running with adjustable resistance and more particularly pertains to exercising with a device with variable resistance which simulates skiing, walking and running.

2. Description of the Prior Art

The use of exercise devices is known in the prior art. More specifically, exercise devices heretofore devised and utilized for the purpose of providing a predetermined muscle movement are known to consist basically of familiar, expected, and obvious structural configurations, notwithstanding the myriad of designs encompassed by the crowded prior art which has been developed for the fulfillment of countless objectives and requirements.

The prior art discloses a large number of exercise devices. By way of example, U.S. Pat. Nos. 4,729,558 to Kuo; 4,842,266 to Sweeney; 4,865,331 to Kuo; 4,886,266 to Trulaske and 4,927,138 to Ferrari all disclose exercise devices of the treadmill variety normally requiring electrical components for operation and use.

U.S. Pat. No. 4,779,863 to Yang discloses a running exercise bicycle.

Lastly, U.S. Pat. No. 4,456,248 to Smith discloses a exercise table for runners.

In this respect, the in place exercise devices for simulating skiing, walking and running with adjustable resistance according to the present invention substantially departs from the conventional concepts and designs of the prior art, and in doing so provides an apparatus primarily developed for the purpose of exercising with a device with variable resistance which simulates skiing, walking and running.

Therefore, it can be appreciated that there exists a continuing need for new and improved in place exercise devices for simulating skiing, walking and running with adjustable resistance which can be used for exercising with a device with variable resistance which simulates skiing, walking and running. In this regard, the present invention substantially fulfills this need.

SUMMARY OF THE INVENTION

In view of the foregoing disadvantages inherent in the known types of exercise devices now present in the prior art, the present invention provides an improved in place exercise device for simulating skiing, walking and running with adjustable resistance. As such, the general purpose of the present invention, which will be described subsequently in greater detail, is to provide a new and improved in place exercise devices for simulating skiing, walking and running with adjustable resistance and method which has all the advantages of the prior art and none of the disadvantages.

To attain this, the present invention essentially comprises an in place exercise device for simulating skiing, walking and running with adjustable resistance comprising, in combination, a base plate positionable in a horizontal orientation having an upper surface and with parallel longitudinal slots formed therein, foot supporting receptacles adapted to receive the feet of a user on the upper surface thereof with mechanisms beneath the lower surfaces thereof extending through the slots to allow for the lifting as well as the forward and rearwardly shifting of the receptacle and feet of a user and with liftable mechanisms interconnecting the upper and lower surfaces of the receptacles, a support plate in a vertical orientation having an upper edge and a lower edge, the lower edge coupled to the forward edge of the base plate, a plurality of weights coupled with respect to the vertical support plate with a key to vary the amount of weights to be coupled for being lifted as a function of the desire of the user, flexible coupling means interconnecting the lower extent of the foot receptacles with the weights, the coupling means being separably attached to each foot receptacle but commonly attached to the weights, the coupling including pulleys whereby the raising or rearward movement of either of the foot components will effect the raising of the preselected number of weights while the lowering or the forward movement of either of the foot components will effect the lowering of the preselected number of weights and generally vertically extending bars pivotally coupled to the base plate adjacent to the forward end with pivot pins at their lower ends and with handles at their upper ends adapted to be grasped and moved by the user during a skiing/walking/running exercise, the bars being provided with supplemental linkages pivotally coupled at their upper ends to an immediate extent of the pivotable bars and at their lower ends to the baseplate and with resistance adjustment means secured with respect thereto.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is a further object of the present invention to provide new and improved in place exercise devices for simulating skiing, walking and running with adjustable resistance which are of durable and reliable constructions.

An even further object of the present invention is to provide new and improved in place exercise devices for similating skiing, walking and running with adjustable resistance which are susceptible of a low cost of manufacture with regard to both materials and labor, and which accordingly are then susceptible of low prices of sale to the consuming public, thereby making such in place exercise devices for simulating walking and running with adjustable resistance economically available to the buying public.

Still yet another object of the present invention is to provide new and improved in place exercise devices for simulating skiing, walking and running with adjustable resistance which provide in the apparatuses and methods of the prior art some of the advantages thereof, while simultaneously overcoming some of the disadvantages normally associated therewith.

Still another object of the present invention is to exercising with a device with variable resistance which simulates skiing, walking and running.

Lastly, it is an object of the present invention to provide new and improved device for simulating skiing, walking and running with adjustable resistance comprising a base plate positionable in a horizontal orientation having an upper surface and with parallel longitudinal slots formed therein, foot supporting receptacles adapted to receive the feet of a user on the upper surface thereof with mechanisms beneath the lower surfaces thereof extending through the slots to allow for the forward end rearwardly shifting of the receptable and feet of a user and with liftable mechanisms interconnecting the upper and lower surfaces of the receptacles, a support plate in a vertical orientation having an upper edge and a lower edge, the lower edge coupled to the forward edge of the base plate, a plurality of weights coupled with respect to the vertical support plate with a key to vary the amount of weights to be coupled for being lifted as a function of the desire of the user, flexible coupling means interconnecting the lower extent of the foot receptacles with the weights, the coupling means being separably attached to each foot receptacle but commonly attached to the weights, the coupling including pulleys whereby upward or rearward movement of either of the foot components will effect the raising of the preselected number of weights while the downward or forward movement of either of the foot components will effect the lowering of the preselected number of weights.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED

Figure 1:
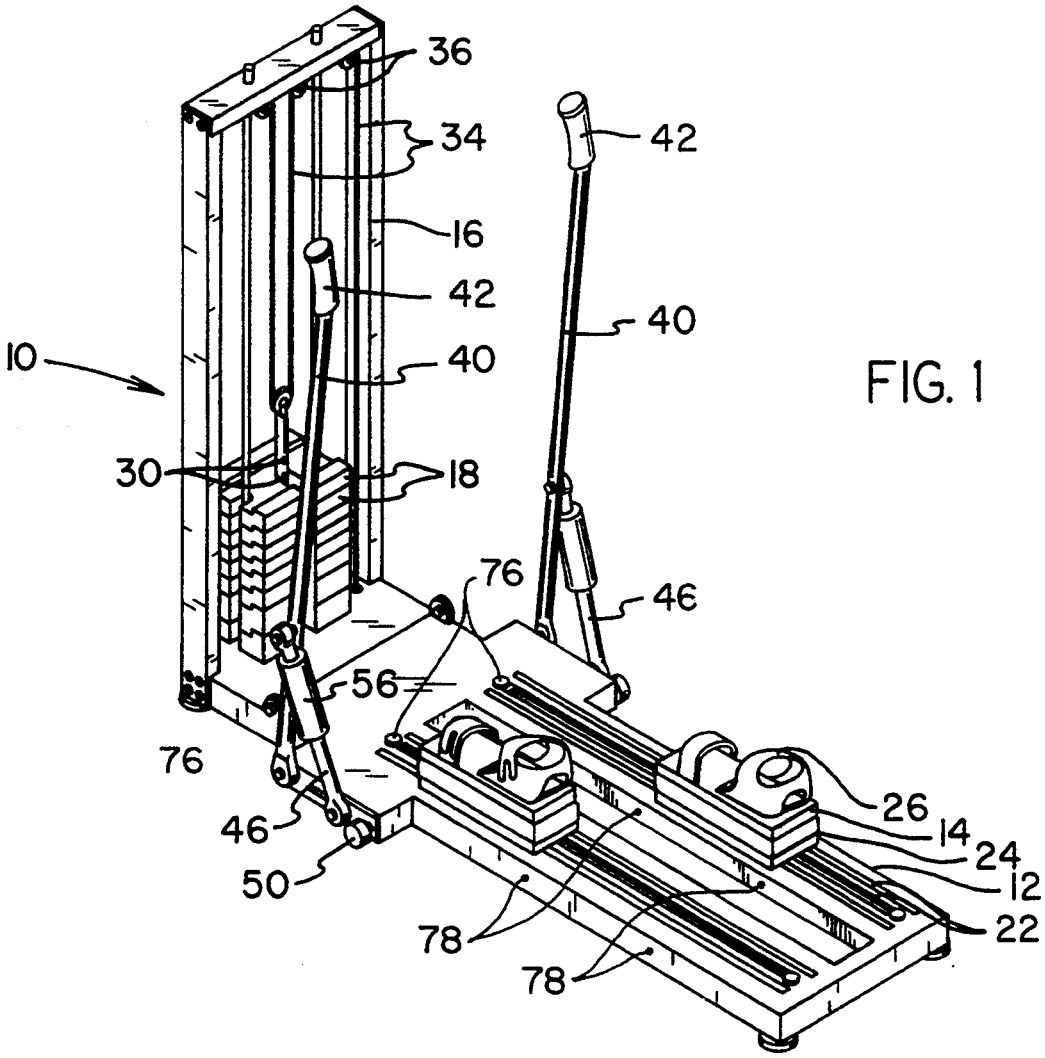
FIG. 1 is a perspective illustration of the in place exercise device for simulating skiing, walking and running with adjustable resistance constructed in accordance with the principles of the present invention.

With reference now to the drawings, and in particular to FIG. 1 thereof, the preferred embodiment of the new and improved in place exercise devices for simulating skiing, walking and running with adjustable resistance embodying the principles and concepts of the present invention and generally designated by the reference numeral 10 will be described.

Figure 2:
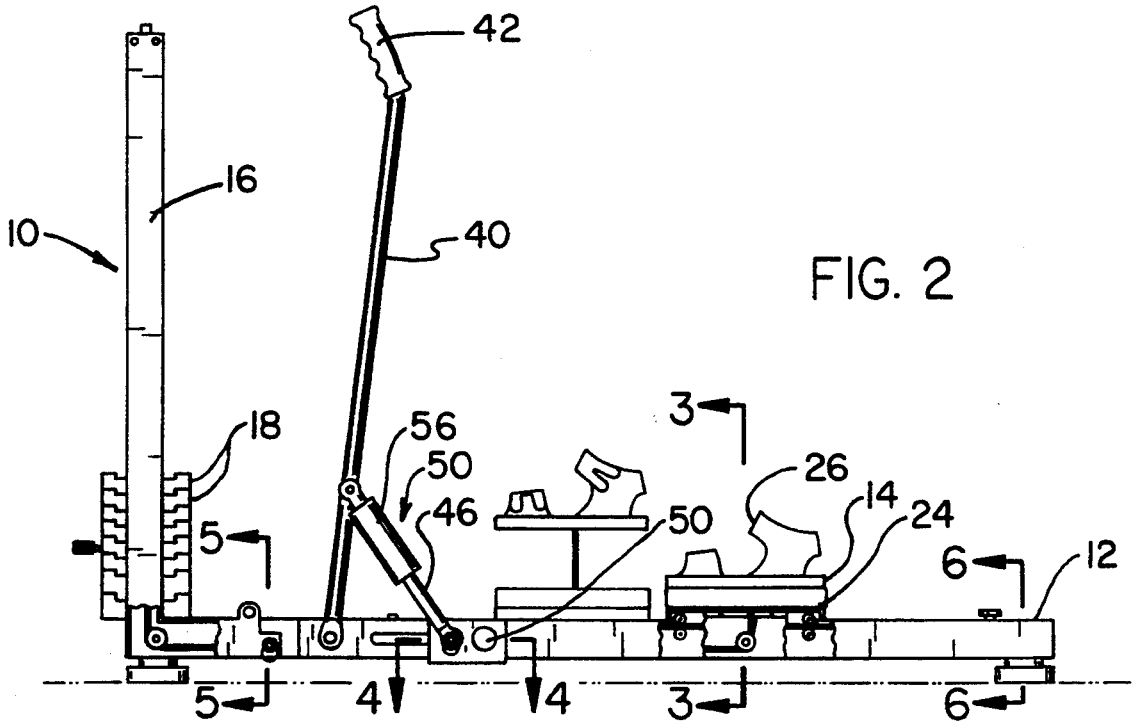
FIG. 2 is a side elevational view of the device as shown in FIG. 1.
Figure 3:
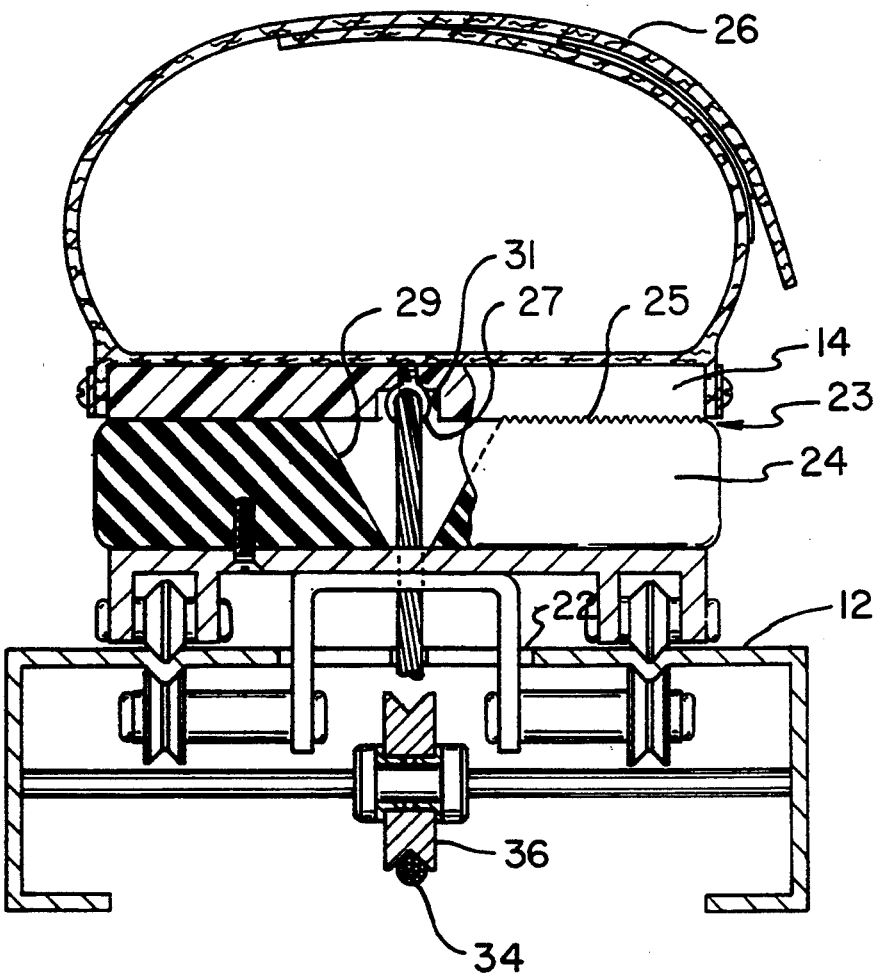
FIG. 3 is a cross sectional view taken along line 3—3 of FIG. 2.

More specifically, it will be noted with particular reference to FIGS. 1 and 2 that the present invention relates to an in place exercise device 10 for simulating skiing, walking and running. Adjustable resistance is provided. The device 10 comprises, in its broadest context, a base plate 12 with foot receptacles 14, a support plate 16 with weights 18 and components therebetween. More specifically, the base plate 12 is positionable in a horizontal orientation. In has an upper surface with parallel longitudinal slots 22 formed therein. Located in the upper surface are slide blocks 24 adapted to receive the foot receptacles 14 and feet of a user on the upper surface thereof. Mechanisms are located beneath the lower surface and are positioned through the slots 22 to allow for the forward and rearwardly shifting of the feet of a user. Mechanisms 24 interconnect the upper and lower surfaces of the foot receptacle to allow for vertical movement of a user's feet. Such mechanisms 23 include a frictional, anti-slide surface 25 on the lower surface of the block of the foot receptacle 14 cooperable with the frictional, anti-slide surface 25 on the upper surface of the slide block 24. This allows for the sliding movement of the foot and foot receptacle to slide the slide block 24 and raise and lower the weights 18 through the cable 34.

The mechanisms also include an eyelet 27 coupled to the foot receptacle 14. In addition, each slide block 24 has its eyelet 27 located within a recess 31 of the receptacle 14. In this manner, foot receptacle 14 must be big enough so that eyelet 27, the bottom screw, can be long and wide enough to support the weight to be lifted. In this manner, the bottom of the eyelet could be flush with the bottom surface of foot receptacle 14 or be located slightly thereabove. This allows for the raising and lowering of the foot and foot receptacle 14 to raise and lower the weights 18 through the cable 34. Straps 26 are provided for coupling to a user's feet. A vertical support plate 16 has an upper edge and a lower edge. The lower edge is coupled to the forward edge of the base plate 12.

A plurality of weights 18 are coupled with respect to the vertical support plate 16. A key with holes 30 allow the user to vary the amount of weights to be lifted as a function of the desire of the user as is conventional.

Flexible coupling means in the form of cables, 34 interconnect the lower extent of the foot receptacles 14 with the weights 18. Pulleys 36 guide the cables. The flexible cables 34 are separably attached to each foot component but commonly attached to the weight components. The flexible cables in association with the pulleys are interrelated whereby upward or rearward movement of either foot receptacle 14 will effect the raising of the preselected number of weights 18. The downward or forward movement of either of the foot receptacle 14 will effect the lowering of the preselected weights 18. In the preferred mode of operation, the user will exercise through the lifting of weights through the upward and downward movement of his or her feet alternately or by the forward and rearward movement of his or her feet alternately. It is preferred not to use compound upward/downward and forward/rearward movement simultaneously.

Generally vertically extending bars 40 are pivotally coupled to the base plate 12 adjacent to its forward end. Handles 42 are provided at the upper ends of the bars 40 to be grasped and moved by the user during a skiing-/walking/running exercise. Pivot pins are provided at the lower ends of the bars and are adapted to provide the point of rotation for the bars 40 with respect to the base plate 12.

The bars 40 are provided with supplemental linkages 46 pivotally coupling to an immediate extent of each bar 40 and pivotally coupled with respect to an adjacent lateral edge of the base plate. Resistance adjustment components 50 are secured with respect to the lower end of the linkages 46. Such adjustment components include a bolt 52 selectively positionable in slot 54. Such positioning will indent or contract the distance the bars 40 move during operation and use. An air spring 56 provides a constant resistance to movement of each bar.

Figure 4:
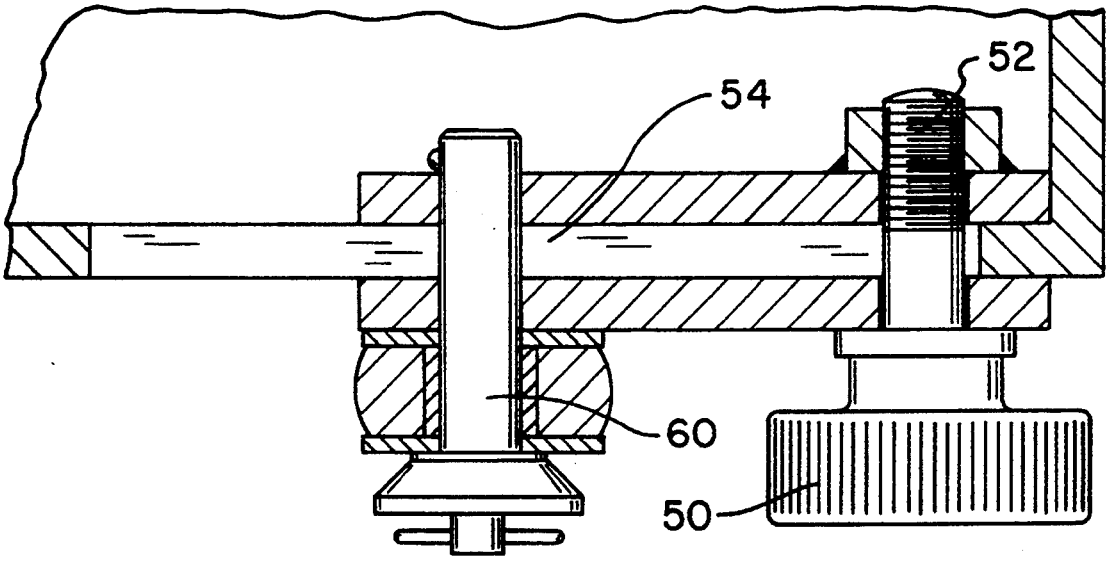
FIG. 4 is a cross sectional view taken along line 4—4 of FIG. 2.
Figure 5:
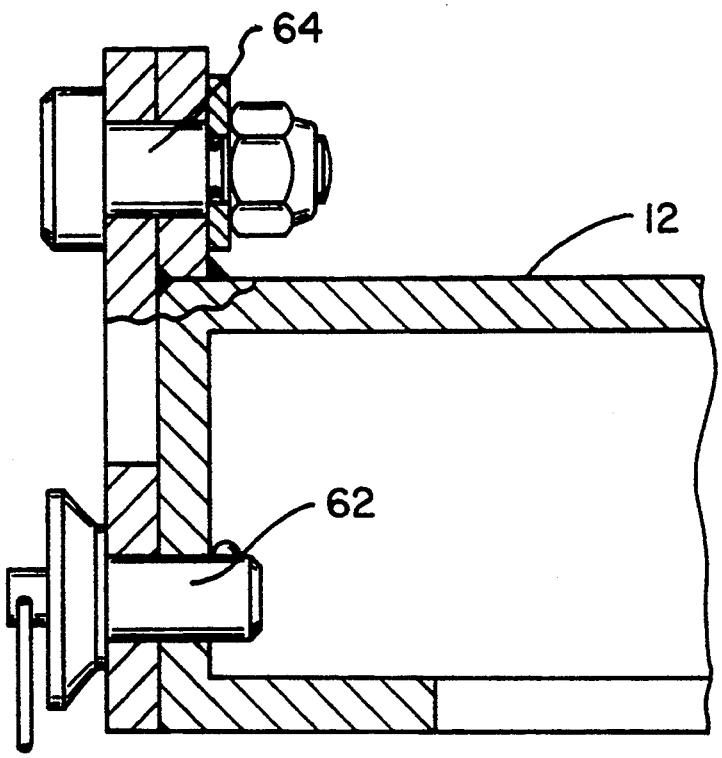
FIG. 5 is a cross sectional view taken along line 5—5 of FIG. 2.
Figure 6:
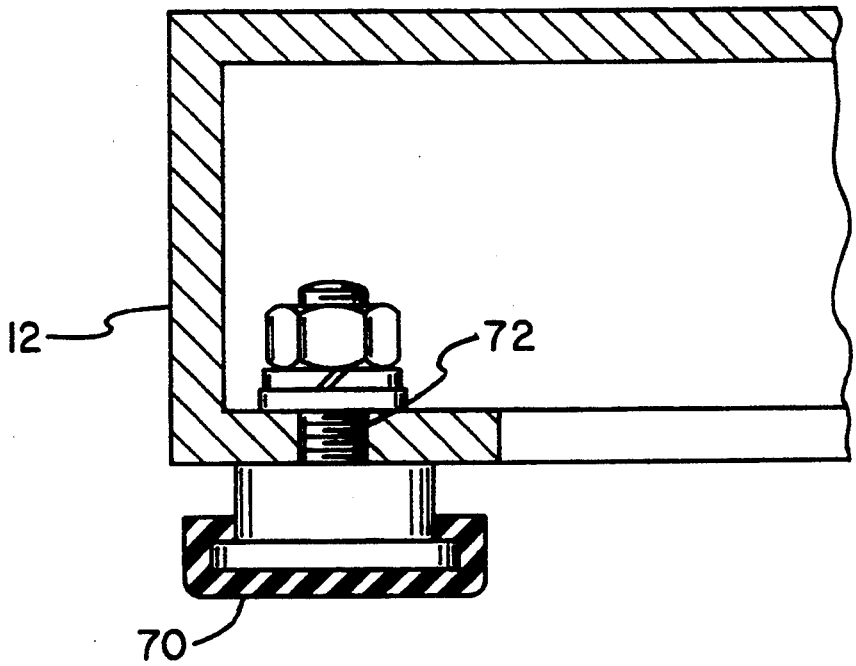
FIG. 6 is a cross sectional view of a rubber stop to limit the movement of the foot pieces.
Figure 7:
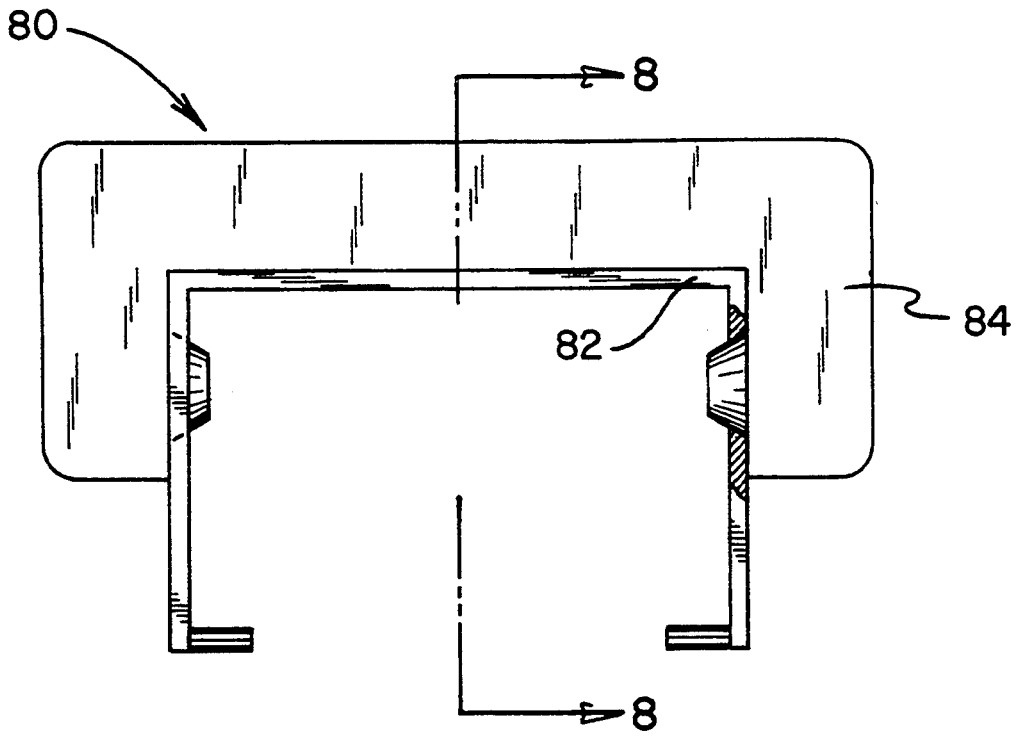
FIG. 7 is a rear elevational view of a rubber stop.
Figure 8:
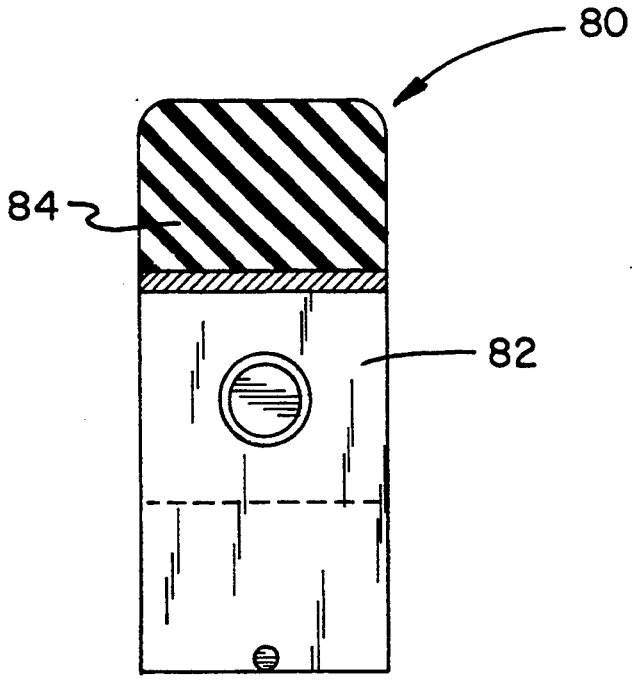
FIG. 8 is a cross sectional view taken along line 8—8 of FIG. 7.

FIG. 4 illustrates the adjusting bolt 52 and slot 54 as well as a quick disconnect pin 60 which when removed, allows the bars 40 to collapse. FIG. 5 shows another quick disconnect pin 62 and a bolt 64 with as associated nut which, when removed, allow the support plate 16 to be folded flat with respect to the base plate 12. Lastly, FIG. 6 shows the foot pads with their adjusting bolts 72 and nuts for leveling the device.

FIG. 1 illustrates rubber stops 76 to abate excessive forward movement of the reciprocating foot receiving members as they slide forwardly and rearwardly within their respective tracks. However, it should be understood that the device could be used wherein the person exercising merely raises and lowers his feet one at a time rather than slides them forwardly and rearwardly. In order to facilitate such a mode of operation, holes 78 are provided in the frame of the machine both on the exterior faces as well as the interior faces. Such holes effectively divide the sliding tracks into three segments of essentially equal length. In association therewith removable rubber stops 80 are employed. Such rubber stops 80 include an interior support as of a metallic material in an inverted U-shaped configuration. The lower ends extend inwardly for being removably positioned within pairs of holes 78. The lower ends of member 82 are resiliently biased toward each other but may be moved outwardly to allow mounting and dismounting. Further, the interior mounting member 82 is covered with a block-like stop 84 for being positioned on the main component through holes 78. In this manner, when the user wishes to exercise in a mode where his feet raise and lower but do not slide, such stops 80 will be placed in holes 84 with each foot receiving member in a forward intermediate or rearward position as a function of the desired exercise to do. When, however, exercise is to include the sliding motion of a foot or feet of a user, the rubber stops 80 are removed.

The present invention is a new kind of exercise machine. It duplicates running motions and works on the muscle groups one would use while running. The two closest machines on the market are the Nordic Ski Track which duplicates a cross country ski motion without lifting of the feet. Unlike the present invention, the users feet slide but don't lift off the ground. The second machine is the Stair Walker/Climber. With such machine, a ladder or stair continuously moves, forcing the user to continually climb. They are very expensive and require heavy electrical motors to move the stairs. The present invention has certain advantages over both. It is cheaper, it can be made to fold down for easy storage, it saves space, it better duplicates foot and arm motions which are integral skills needed for most sports, etc.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An in place exercise device for simulating skiing, walking and running with adjustable resistance comprising, in combination:

a base plate positionable in a horizontal orientation having an upper surface and with parallel longitudinal slots formed therein;

foot supporting receptacles adapted to receive the feet of a user on the upper surface thereof comprising mechanisms beneath the lower surfaces thereof extending through the slots to allow for the forward and rearwardly sliding of the receptacle and feet of a user and further including liftable mechanisms interconnecting the upper and lower surfaces of the receptacles;

a support plate in a vertical orientation having an upper edge and a lower edge, the lower edge coupled to the forward edge of the base plate;

a plurality of weights coupled with respect to the vertical support plate with a key to vary the amount of weights to be coupled for desired lifting by the user;

flexible coupling means interconnecting the lower extent of the foot receptacles with the weights, the coupling means being separably attached to each foot receptacle but commonly attached to the weights, the coupling including pulleys whereby upward and rearward movement of either of the foot components will effect the raising of the preselected number of weights while the downward and forward movement of either of the foot components will effect the lowering of the preselected number of weights; and generally vertically extending bars pivotally coupled to the base plate adjacent to the forward end with pivot pins at their lower ends and with handles at their upper ends adapted to be grasped and moved by the user during a skiing/walking/running exercise, the bars being provided with supplemental linkages pivotally coupled at their upper ends to an immediate extent of the pivotable bars and at their lower ends to the base plate and with resistance adjustment means secured with respect thereto.

2. A device for simulating skiing, walking and running with adjustable resistance comprising:

a base plate positionable in a horizontal orientation having an upper surface and with parallel longitudinal slots formed therein;

foot supporting receptacles adapted to receive the feet of a user on the upper surface thereof comprising mechanisms beneath the lower surfaces thereof extending through the slots to allow for the forward and rearwardly sliding of the receptacle and feet of a user and further including liftable mechanisms interconnecting the upper and lower surfaces of the receptacles;

a support plate in a vertical orientation having an upper edge and a lower edge, the lower edge coupled to the forward edge of the base plate;

a plurality of weights coupled with respect to the vertical support plate with a key to vary the amount of weights to be coupled for desired lifting by the user; and flexible coupling means interconnecting the lower extent of the foot receptacles with the weights, the coupling means being separably attached to each foot receptacle but commonly attached to the weights, the coupling including pulleys whereby upward and rearward movement of either of the foot components will effect the raising of the preselected number of weights while the downward and forward movement of either of the foot components will effect the lowering of the preselected number of weights.

3. The device as set forth in claim 2 and further including:

generally vertically extending bars pivotally coupled to the base plate adjacent to the forward end with pivot pins at their lower ends and with handles at their upper ends adapted to be grasped and moved by the user during a skiing/walking/running exercise, the bars being provided with supplemental linkages pivotally coupled at their upper ends to an immediate extent of the pivotable bars and at their lower ends to the baseplate and with resistance adjustment means secured with respect thereto.

4. The device as stated forth in claim 3 and further including:

quick disconnect pins coupling the lower ends of the bars with the base plate.

* * * * *